United States Patent [19]

Youngdale

[11] Patent Number: 4,546,883

[45] Date of Patent: Oct. 15, 1985

[54] PORTABLE WINE RACK

[76] Inventor: Ralph A. Youngdale, 4701 Sierra, Howell, Mich. 48843

[21] Appl. No.: 682,927

[22] Filed: Dec. 18, 1984

[51] Int. Cl.[4] ..... B65D 81/02

[52] U.S. Cl. ..... 206/521; 211/74; 206/326; 206/426; 206/216

[58] Field of Search ..... 211/74, 71, 37, 34; 206/521, 426, 216, 326

[56] References Cited

U.S. PATENT DOCUMENTS

| | | | |
|---|---|---|---|
| 1,687,138 | 10/1928 | Myers | 211/74 |
| 1,913,033 | 6/1933 | Kwapil | 211/74 |
| 2,012,983 | 9/1935 | Bales | 211/74 |
| 3,467,259 | 9/1969 | Silver | 211/74 |
| 4,023,681 | 5/1977 | Plant | 211/74 |
| 4,258,847 | 5/1981 | Nierman | 211/74 |

*Primary Examiner*—Joseph Man-Fu Moy
*Attorney, Agent, or Firm*—Krass and Young

[57] ABSTRACT

A wine rack comprising spaced pairs of elongated frame members arranged in upstanding steepled configuration with their bases spaced and their tops joined with shelf assemblies extending between the pairs of upstanding frame members to provide bottle storage on the outer surfaces of the A frame and hanger brackets extending between the pairs of upstanding frame members between shelf assemblies and including inwardly opening slots to provide hanging storage of a plurality of wine glasses in the umbrella provided by the A frame. A shipping assembly for the wine rack is also disclosed.

13 Claims, 4 Drawing Figures

PORTABLE WINE RACK

BACKGROUND OF THE INVENTION

This invention relates to wine racks and, more particularly, to wine racks especially suited for transport between various locations.

Wine racks have been in existence for as long as people have enjoyed wine. Over the years, a myriad of rack structures have been proposed to facilitate the storage of wine bottles and/or associated glassware. Whereas each of these rack structures has served admirably to satisfy the peculiar requirements of each wine storage specification, none of the prior art racks have provided a totally satisfactory and totally universal arrangement for storing both wine bottles and associated glassware and, in particular, none of the prior art wine racks have provided a totally satisfactory portable structure which functions to efficiently store both wine bottles and associated glassware and which is yet readily transportable between various locations.

BRIEF SUMMARY OF THE INVENTION

The present invention is directed to the provision of a wine rack which efficiently stores both wine bottles and associated glassware and which is readily portable.

The invention wine rack, in its broadest sense, comprises a plurality of frame members defining an A frame; bottle storage means on the exterior sloping surfaces of the A frame defining a plurality of horizontal support surfaces each configured to support a horizontally disposed wine bottle thereon; and glass storage means on the A frame for supporting a plurality of wine glasses in vertical position within the umbrella of the A frame. The A frame includes a first pair of first and second elongated frame members arranged in upstanding steepled configuration with their bases spread and their tops joined and a second pair of first and second elongated frame members arranged in upstanding steepled configuration with their bases spread and their tops joined. The glass storage means comprises first and second hanger brackets extending horizontally between the first frame members and the second frame members, respectively, at a location between the bases and tops of the frame members. Each hanger bracket includes a plurality of slots opening at the inner edge of the respective hanger bracket in confronting relation to the slots in the other hanger bracket and the confronting inner edges of the hanger brackets are spaced apart to allow movement of the stems of wine glasses through the area beneath the steepled frame members, into the space between the hanger brackets and into the slots in the hanger brackets, to allow hanging, upside down storage of wine glasses on the hanger brackets with the bases of the glasses seated on top of the hanger brackets, the stems positioned in the slots in the hanger brackets, and the bowls hanging below the brackets.

According to a further feature of the invention, the bottle storage means comprises a plurality of shelf assemblies extending horizontally between the upstanding frame member pairs at vertically spaced locations thereon and each adapted to support a horizontally disposed wine bottle thereon. Each shelf assembly includes a pair of shelf members arranged to form an upwardly opening V to cradle a wine bottle therein.

According to a further feature of the invention, the hanger brackets extend between the frame members at vertical locations thereon between successive shelf assemblies so that the bowls of wine goblets hung from a hanger bracket are positioned within the A frame directly behind a wine bottle stored on the shelf assembly immediately below the hanger bracket.

According to a further feature of the invention, the inner edges of the upstanding frame members are essentially straight and the outer edges of the frame members are scalloped to define relatively horizontal runs adjacent each shelf assembly and relatively vertical runs between successive shelf assemblies with a vertical run joining a horizontal run in curvilinear fashion to form an arcuate cradle for cradling receipt of the neck of a wine bottle stored on the associated shelf assembly.

According to a further feature of the invention, a free standing bar extends horizontally between the joined tops of the upstanding pairs of frame members to provide a handle for the wine rack to facilitate ready transport of the wine rack between various locations.

The present invention is also directed to a wine rack shipping assembly for use in storing and shipping the invention wine rack.

The invention shipping assembly includes a wine rack defining an A frame structure; a rectangular parallelepiped container having height, width and length measurements generally corresponding to those of the A frame structure; means on the wine rack for suspending a plurality of wine glasses within the umbrella of the A frame structure; a plurality of wine glasses suspended within the A frame structure by the suspension means; and a packing structure of soft material sized to fit within the container and rest on the floor of the container and including partition means defining a plurality of upwardly opening compartments corresponding in number to the number of wine glasses and having a size and array corresponding to the size and array of the wine glasses in their suspended array within the A frame structure. With this arrangement, the packing structure may be placed on the floor of the container and the wine rack A structure, with the glasses suspended in the umbrella of the A structure, may be inserted into the container to insert the glasses respectively into the compartments of the packing structure to preclude breakage of the glasses during shipment and storage.

According to a further feature of the invention shipping assembly, the glass suspension means includes a pair of parallel horizontal plate members forming a part of the A frame structure and arranged lengthwise in the A frame structure, and the compartments of the packing structure have a height generally corresponding to the distance from the underside of the plate members to the base of the wine rack so that as the A frame structure, with the glasses suspended therewithin, is lowered into the compartments, the upper edges of the compartments ultimately seat against the undersurface of the plate members to provide a solid package configuration.

According to a further feature of the invention shipping assembly, the packing structure includes two parallel rows of compartments and a central portion disposed between the rows and extending upwardly above the top of the compartments and the A frame structure includes a horizontal handle spaced above the base of the rack by a distance generally corresponding to the height of the central portion of the packing structure so that as the A frame is lowered over the packing structure to dispose the glasses within the compartments and seat the tops of the compartments against the undersides of the suspension plate members, the upper surface of the central portion of the packing structure seats against the undersurface of the handle to further solidfy the overall packing configuration.

According to a further feature of the invention shipping assembly, the assembly further includes a further packing member in the form of an inverted U which fits over the top of the inserted wine rack with slots in the depending legs portions of the U-shaped packing member passing over the handle member and seating the upper portion of the packing structure therewithin to further solidify the overall packing structure.

DETAILED DESCRIPTION OF THE PREFERRED EMBODIMENT

Figure 1:
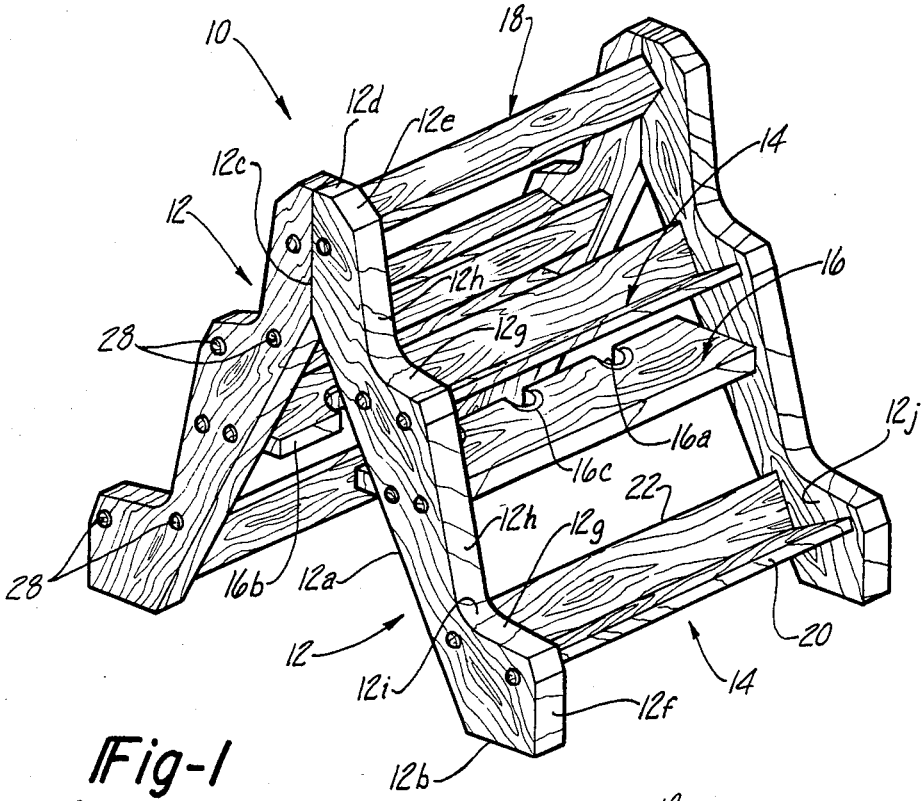
FIG. 1 is a perspective view of the wine rack according to the invention.

The invention wine rack 10 includes frame members 12; shelf assemblies 14; hanger brackets 16; and a handle 18. The various members are preferably formed of a relatively hard wood such for example as bass or oak, but the invention wine rack may of course be formed from any suitable material.

The wine rack includes four identical frame members 12. Each frame member is preferably formed from a single hard wood board shaped to define a straight inner edge 12*a*, a straight bottom edge 12*b*, a straight upper joinder edge 12*c*, a straight top edge 12*d*, a straight beveled edge 12*e*, a straight side edge 12*f*, and a scalloped outer edge including relatively horizontal runs 12*g* and relatively vertical runs 12*h*. Frame members 12 are arranged in pairs in upstanding steepled configuration with joinder edges 12*c* juxtapositioned to form a joint between the upstanding frame members and straight inner edges 12*a* splaying outwardly and downwardly to form an A frame configuration.

Shelf assemblies 14 extend horizontally between the upstanding pairs of the frame members 12 at vertically spaced locations thereon. Each shelf assembly 14 includes a board 20 and a second board 22 coacting to form an upwardly opening V to cradle a wine bottle therein. The scalloping of the outer edges of the frame members 12 is such that a vertical run 12*h* joins a horizontal run 12*g* in curvilinear fashion generally above each shelf assembly 14 so that the scalloped outer edge of the related frame member 12 forms an arcuate cradle 12*i* for loose cradling receipt of the neck 24*a* of a bottle 24 positioned on the associated shelf assembly. End surfaces 12*j* defined by frame members 12 limit endwise movement of bottles 24 on shelf assemblies 14 and preclude endwise sliding movement of the bottles off of the shelf assemblies.

Hanger brackets 16 comprises boards extending between the upstanding frame member pairs at a vertical location between successive shelf assemblies. Each hanger bracket 16 includes a plurality of slots 16*a* opening at the inner edge 16*b* of the hanger bracket in confronting relation to the slots in the other hanger bracket. The confronting inner edges 16*b* of the hanger brackets are spaced apart sufficiently to allow movement of goblet type wine glasses 26 through the area beneath the steepled frame members, into the space between the hanger brackets, and into the slots to allow hanging upside down storage of wine glasses 26 on the brackets with the bases 26*a* of the glasses seated on top of the brackets 16, the stems 26*b* of the glasses positioned in slots 16*a* and the bowls 26*c* of the glasses hanging below the brackets. Slots 16*a* are chamfered along their upper edges, as seen at 16*c*, to preclude inadvertent inward sliding movement of the glasses out of the slots. Specifically, each chamfer 16*c* extends around the inner radius of the associated slot and along the sides of the slots but runs out as seen at 16*d*, before reaching inner edge 16*b* so that the glass drops into the chamfer as it is moved into the slot and the glass must be deliberately run up the chamfer portion 16*d* in order to exit from the slot. The spacing between the inner edges of the hanger brackets 16 is sufficient to allow a glass 26 to be withdrawn from one of the hanger brackets 16 even with a glass positioned in the opposing slot of the other hanger bracket 16. Brackets 16 are positioned directly beneath the top shelf assembly 14 so that the bowls 26*c* of glasses 26 hanging from the brackets are positioned within the umbrella of the A frame directly behind a wine bottle 24 stored on the lower shelf assembly 14 in a position where they adequately clear the shelf 22 of that shelf assembly.

Handle 18 extends horizontally between the joined top sections of the upstanding pairs of frame members 12 and is free standing so as to be readily grasped by a user to transport the wine rack between various locations.

The various wooden elements of the rack are joined together by suitable gluing at their respective interfaces and by nails or staples driven endwise through frame members 12 and into shelf members 20 and 22, hanger bracket 16, and handle 18. Decorative wooden buttons 28 may be adhesively secured to the outer face of frame members 12 at the point of entry of the nails or staples to hide the staples and to impart a customed pegged construction appearance to the wine rack.

The invention wine rack provides ready and convenient storage of a plurality of wine bottles and associated glassware and provides a rack that is readily portable between various locations. The wine rack construction is sturdy, durable and relatively inexpensive and readily lends itself to mass production and mass shipment.

Figure 2:
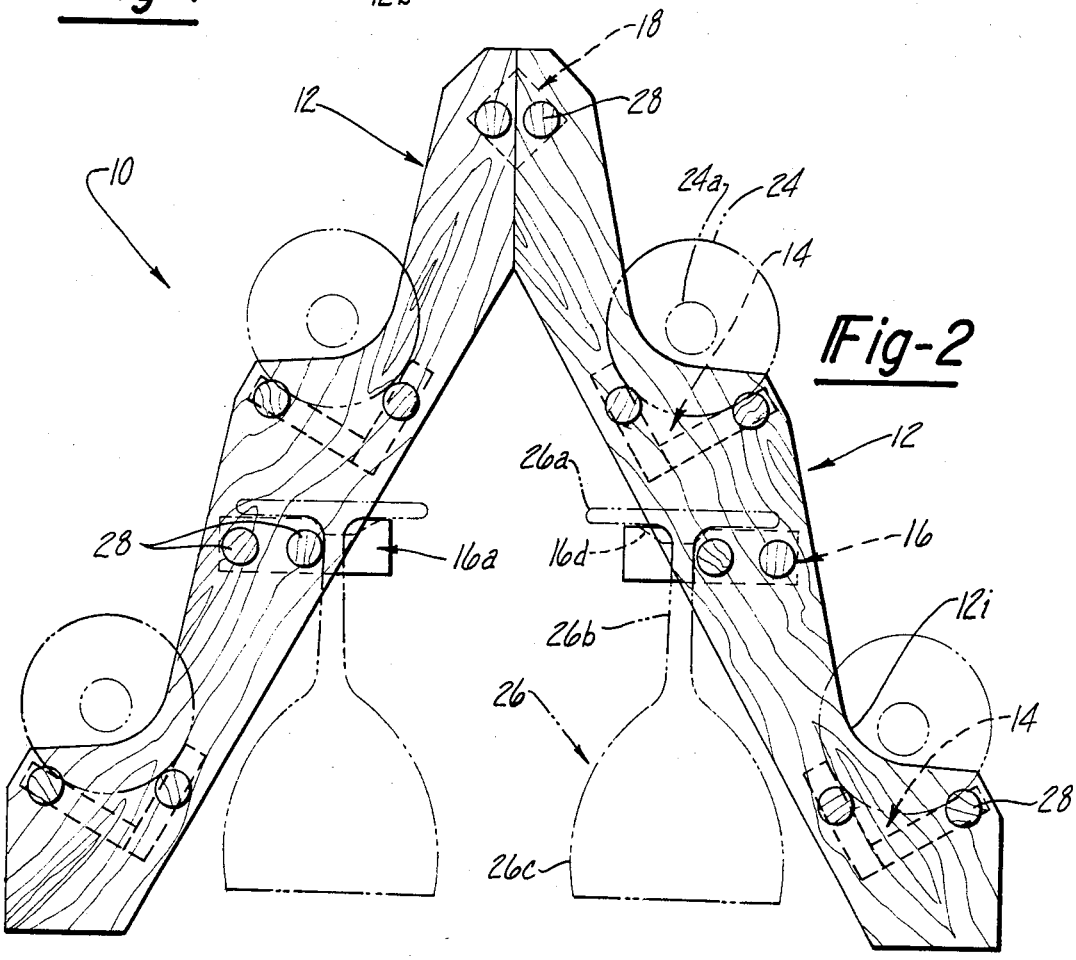
FIG. 2 is a cross sectional view of the invention wine rack taken on lines 2—2 of FIG. 1.
Figure 3:
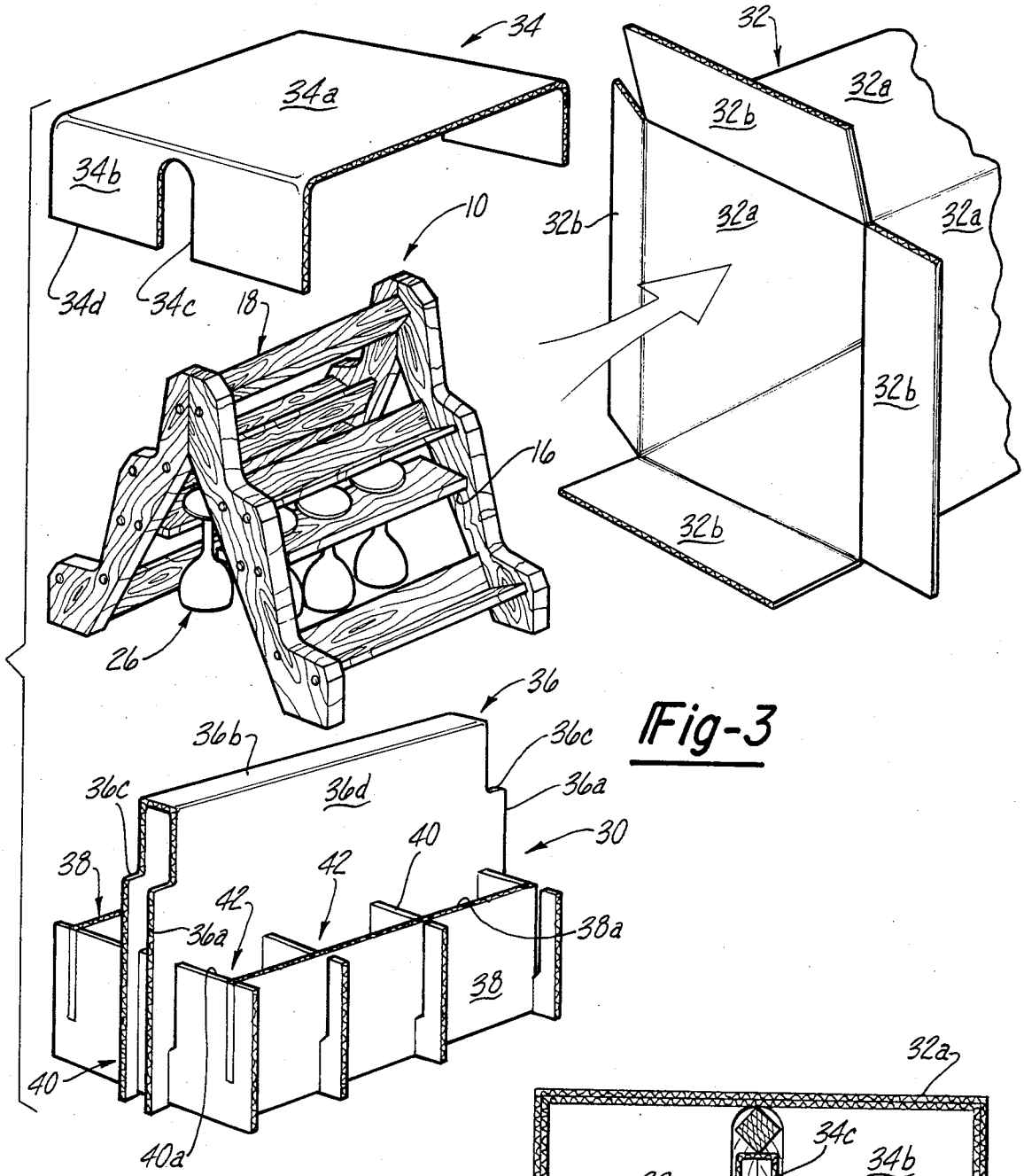
FIG. 3 is an exploded view of the wine rack shipping assembly according to the invention.
Figure 4:
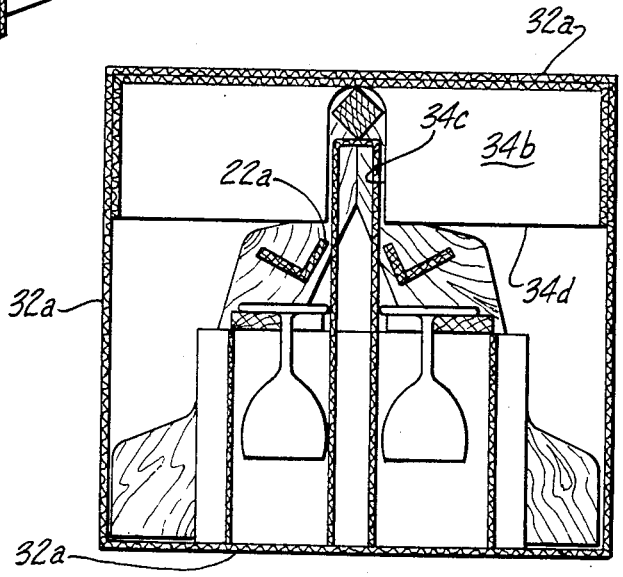
FIG. 4 is a cross sectional view of he invention shipping assembly in assembled configuration.

The wine rack shipping assembly according to the invention is seen in FIGS. 3 and 4. The shipping assembly includes the wine rack 10 complete with glasses 26; a packing structure 30; a container 32; and a packing member 34. Wine rack 10 is as described with reference to FIGS. 1 and 2.

Packing structure 30 is formed of cardboard and includes a central partition member 36 formed into an inverted U configuration; lengthwise partition members 38 and transverse partition members 40. Central partition member 36 and partitions 38 and 40 are mutually slotted and interfitted together in egg carton fashion to form a plurality of compartments 42 on either side of upstanding partition member 36. In the disclosed central, there are three partitions 42 on either side of central partition 36 to correspond to the number and array of the glasses 26 suspended within the umbrella of the A frame structure of rack 10.

Container 32 is a rectangular parallelepiped having length, height and width dimensions generally corresponding to those of wine rack A frame structure 10.

Packing member 34 is formed of cardboard and is in the form of an inverted U having a bight portion 34*a*, depending leg portions 34*b*, and downwardly opening slots 34*c* formed in leg portions 34*b*. Slots 34*c* have a width generally corresponding to the width of wine rack handle member 18 and to the width of upstanding partition 36 of packing structure 30.

The assembled configuration of the various elements of the shipping assembly is seen in FIG. 4. To assemble the various elements, packing structure 30 is placed in container 32 and rests on the floor of the container with the lower side edges 36*a* of central partition 36 juxtaposed to the end faces 32*a* of container 32. Wine rack 10, complete with suspending glasses 26, is now lowered into container 32 with central packing structure partition 36 passing between the rows of suspended glasses so that the glasses are respectively inserted into compartments 42. The height of partitions 38 and 40 generally corresponds to the distance between the lower face of hanger brackets 16 and the base of the wine rack so that the upper edges 38*a* and 40*a* of partitions 38 and 40 seat against the underface of hanger brackets 16 as the glasses assume their fully seated position within compartments 42. The height of central partition 36 corresponds generally to the distance from the underside of handle 18 to the base of wine rack 10 so that, as the glasses assume their fully seated position within compartments 42, the top edge 36*b* of central partition 36 seats against the under edge of handle 18. Central partition 36 is necked inwardly at shoulders 36*c* so that the upper portion 36*d* of the partition may fit between the steepled upstanding frame members 12. Packing member 34 is now placed over the wine rack within container 32 with slots 34*c* passing over handle 18 and over upper portion 36*d* of central partition 36. The height of leg portions 34*b* of packing member 34 generally corresponds to the distance between the top of the wine rack and the top edge 22*a* of the board members 22 of upper shelf assemblies 14. Accordingly, as packing member 34 assumes its fully inserted position with handle member 18 positioned at the top of slots 34*c*, the lower edges 34*d* of leg portions 34*b* seat on upper edges 22*a* of shelf members 22. The flaps 32*b* of container 32 may now be closed and suitably sealed to complete the shipping assembly. The disclosed shipping assembly will be seen to provide an inexpensive and yet extremely effective arrangement for effectively precluding damage to wine rack 10 and to associated glassware 26 during storage and shipment of wine rack 10.

Whereas a preferred embodiment of the invention has been illustrated and described in detail it will be apparent that various changes may be made in the disclosed embodiment without departing from the scope or spirit of the invention.

I claim:

1. A wine rack comprising:

A. a plurality of frame members defining an A frame;

B. bottle storage means on the exterior sloping surfaces of said A frame defining a plurality of horizontal support surfaces each configured to support a horizontally disposed wine bottle thereon; and C. glass storage means on said A frame for supporting a plurality of wine glasses in vertical position within the umbrella of said A frame.

2. A wine rack according to claim 1 wherein:

D. said glass storage means comprises means for supporting a plurality of glasses in vertically suspended position with said A frame.

3. A wine rack according to claim 2 wherein:

E. said glass storage means is adapted to store goblets and functions to hang the goblets in a base up position within said A frame.

4. A wine rack according to claim 3 wherein:

F. said A frame includes (1) a first pair of first and second elongated frame members arranged in upstanding steepled configuration with their bases spread and their tops joined and (2) a second pair of first and second elongated frame members arranged in upstanding steepled configuration with their bases spread and their tops joined;

G. said glass storage means comprises first and second hanger brackets extending horizontally between said first frame members and said second frame members, respectively, at a location between the bases and tops of said frame members and each including a plurality of slots opening at the inner edge of the respective hanger bracket in confronting relation to the slots in the other hanger bracket with the confronting inner edges of the hanger brackets spaced apart to allow movement of the stems of wine glasses through the area beneath the steepled frame members, into the space between the hanger brackets, and into said slots to allow hanging upside down storage of wine glasses on said brackets with the bases of the glasses seated on top of the brackets, the stems positioned in said slots, and the bowls hanging below the brackets.

5. A wine rack according to claim 4 wherein:

H. said bottle storage means comprises a plurality of shelf assemblies extending horizontally between said upstanding frame member pairs at vertically spaced locations thereon and each adapted to support a horizontally disposed wine bottle thereon.

6. A wine rack according to claim 5 wherein:

I. each shelf assembly includes a pair of shelf members arranged to form an upwardly opening V to cradle a wine bottle therein.

7. A wine rack according to claim 6 wherein:

J. said hanger brackets extend between said frame members at vertical locations thereon between successive shelf assemblies so that the bowls of wine goblets hung from a hanger bracket are positioned within said A frame directly behind a wine bottle stored on the shelf assembly immediately below that hanger bracket.

8. A wine rack according to claim 6 wherein:

K. the inner edges of said frame members are essentially straight and the outer edges of said frame members are scalloped to define relatively horizontal runs adjacent each shelf assembly and relatively vertical runs between successive shelf assemblies with a vertical run joining a horizontal run in curvilinear fashion to form an arcurate cradle for cradling receipt of a neck of a bottle stored on the associated shelf assembly.

9. A wine rack according to claim 8 and further including:

L. a free standing bar extending horizontally between the joined tops of said pairs of frame members to provide a handle for said wine rack.

10. A wine rack shipping assembly comprising:

A. a wine rack defining an A frame structure;

B. means on said wine rack for suspending a plurality of wine glasses within the umbrella of said A frame structure;

C. a plurality of wine glasses suspended within said A frame structure by said suspending means;

D. a rectangular parallelepiped container having height, width and length dimensions generally corresponding to those of said A frame structure; and E. a packing structure of soft material sized to fit within said container and rest on the floor of said container and including partition means defining a plurality of upwardly opening compartments corresponding in number to the number of said wine glasses and having a size and array corresponding to the size and array of the wine glasses in their suspended array within said A frame, whereby said packing structure may be placed on the floor of said container and said wine rack A frame structure, with said glasses suspended in the umbrella thereof, may be inserted into said container to insert said glasses respectively into said compartments to prevent breakage of said glasses during shipment and storage.

11. A shipping assembly according to claim 10 wherein:

F. said suspending means includes a pair of parallel horizontal plate members forming a part of said A frame structure and arranged lengthwise in said structure with the undersurfaces thereof spaced from the plane of the base of said A frame structure by a distance generally corresponding to the height of said glasses, with their inner edges confronting but spaced, and with a plurality of lengthwise spaced slots opening at their respective inner edges for receipt of the stems of said glasses; and G. said compartments of said packing structure have a height generally corresponding to said distance so that as said A frame structure with said glasses suspended therewithin is lowered into said compartments, the upper edges of said compartments ultimately seat against the undersurface of said plate members.

12. A shipping assembly according to claim 11 wherein:

H. said A frame structure further includes (1) a first pair of first and second elongated frame members arranged in upstanding steepled configuration with their bases spread and their tops joined, (2) a second pair of first and second elongated frame members arranged in upstanding steepled configuration with the bases spread and their tops joined, and (3) a free standing bar extending horizontally between the joined tops of said pairs of frame members to provide a handle for said wine rack;

J. said plate members extend horizontally between first frame members and said second frame members, respectively, at a location between said handle and the base of the said A frame structure; and K. said packing structure includes two parallel rows of said compartments and a central portion disposed between said rows and extending upwardly above the tops of said compartments by a distance approximating the distance on said A frame structure between the undersides of said plate members and the undersurface of said handle so that, in the packed configuration, the upper surface of said central portion seats against the undersurface of said handle.

13. A shipping assembly according to claim 12 wherein:

K. said wine rack further includes a plurality of shelf assemblies extending horizontally between said upstanding frame member pairs at vertically spaced locations thereon; and L. said shipping assembly further includes a further packing member in the form of an inverted U, having a width corresponding to the width of said container and including a bight portion and leg portions (1) extending downwardly from said bight portion for a distance generally corresponding to the distance from the top of said frame members to the top edge of the topmost shelf assembly, and (2) each having a slot opening at the lower edge of the leg portion sized to pass said handle and sized to pass said upstanding portion of said packing structure, whereby, following insertion of said packing structure into said container and insertion of said wine rack into said packing structure, said packing member may be inserted into the top of said container over said wine rack with its slots passing said handle and passing over said upstanding central portion of said packing structure and the lower edges of its leg portions seating on the edges of the topmost shelf assemblies, whereafter said container may be closed to complete the shipping assembly.

* * * * *